US008196531B2

(12) United States Patent
Degenkolb et al.

(10) Patent No.: US 8,196,531 B2
(45) Date of Patent: Jun. 12, 2012

(54) COMPACT PULVERIZED COAL BURNER

(75) Inventors: Dietmar Degenkolb, Freiberg (DE); Christian Reuther, Freiberg (DE); Manfred Schingnitz, Freiberg (DE)

(73) Assignee: Siemens Aktiengesellschaft, München (DE)

( * ) Notice: Subject to any disclaimer, the term of this patent is extended or adjusted under 35 U.S.C. 154(b) by 392 days.

(21) Appl. No.: 12/151,405

(22) Filed: May 6, 2008

(65) Prior Publication Data

US 2008/0276845 A1 Nov. 13, 2008

(30) Foreign Application Priority Data

May 10, 2007 (DE) ..... 10 2007 021 925

(51) Int. Cl.
*F23D 1/04* (2006.01)
*F23K 3/02* (2006.01)

(52) U.S. Cl. ..... 110/104 B; 110/261; 110/264; 110/265

(58) Field of Classification Search ..... 110/104 B, 110/264, 265, 261, 263
See application file for complete search history.

(56) References Cited

U.S. PATENT DOCUMENTS

| | | | | |
|---|---|---|---|---|
| 4,333,405 | A * | 6/1982 | Michelfelder et al. | 110/264 |
| 4,474,120 | A * | 10/1984 | Adrian et al. | 110/261 |
| 4,776,289 | A * | 10/1988 | Peter-Hoblyn et al. | 110/347 |
| 4,846,666 | A * | 7/1989 | Bilawa et al. | 431/8 |
| 5,347,937 | A * | 9/1994 | Vatsky | 110/261 |
| 5,451,160 | A * | 9/1995 | Becker | 431/8 |
| 6,196,142 | B1 * | 3/2001 | Ohlsen | 110/264 |

* cited by examiner

*Primary Examiner* — Kenneth Rinehart
*Assistant Examiner* — David J Laux

(57) ABSTRACT

Disclosed is a burner for oxidant gasification of pulverized fuels under high pressures, e.g. 80 bar, and temperatures, e.g. 1200 to 1900° C., in reactors with liquid slag removal for oxygen gasification. The individual pulverized coal supply tubes in the burner are inclined toward the burner axis in the direction of the burner mouth, are implemented equiareally from the burner inlet up to the burner outlet, and end at the burner mouth adjacent to the oxidant outlet. Owing to the pulverized fuel feeding elements being implemented right up to the burner mouth and the instantaneous entry of the pulverized coal into the rotating oxygen stream there is no longer any areal discontinuity at the dust outlet, since here the pulverized coal stream is immediately sucked into the oxidant stream. At the outlet of the media the individual pulverized coal streams merge into a single rotating pulverized coal/oxygen stream, thereby achieving an even flame spread and stabilization.

5 Claims, 1 Drawing Sheet

COMPACT PULVERIZED COAL BURNER

CROSS REFERENCE TO RELATED APPLICATIONS

This application claims the benefits of German application No. 10 2007 021 925.5 filed May 10, 2007 and is incorporated by reference herein in its entirety.

FIELD OF INVENTION

The invention relates to a pulverized coal burner that is used for oxygen gasification of pulverized fuels (brown coals and/or hard coals or similar pulverized fuels) under high pressures and temperatures in reactors with liquid slag removal.

The invention relates to a burner for oxidant gasification of pulverized fuels having the features of the preamble of the claims.

BACKGROUND OF THE INVENTION

Pulverized coal burners for partial oxidation of pulverized fuels, comprising a cylindrical water-cooled housing and internal coaxially disposed annuli for supplying the pulverized fuel and the oxidant, are well known.

Located in the center of the burner is a further small gas/oxygen burner which serves as an igniter or pilot burner and is equipped with an optical flame monitoring device and a high-voltage ignition device. It is used for starting up the abovementioned pulverized coal burner, as disclosed in the patent documents DE 271038 A3 and DE 4306980 C2.

The pulverized fuel is supplied outside and inside the burner through one or more tubes. Inside the burner, the supply tube(s) is (are) run to the burner outlet in such a way that they perform at least one complete rotation about the axis and then end set tangentially adjacent to the burner outlet. At the end of the pulverized fuel tube(s) the pulverized fuel dust enters a cylindrical annulus in a tangential manner.

At the transition from the tube surface area to the annulus there is an abrupt increase in area and therefore a reduction in the pulverized fuel dust velocity.

Although increasing the number of pulverized fuel tubes inside the annulus can reduce the areal discontinuity, it cannot eliminate it.

This results in an uneven distribution of the pulverized fuel stream inside the annulus, which can cause asymmetrical flame spread with unilateral stressing of the reaction chamber.

The known burner has the following disadvantages:

1. complicated design of the tubes inside the cylindrical annulus in the burner
2. after the pulverized coal dust outlet there is an unavoidable areal discontinuity, thereby reducing the dust velocity
3. this areal discontinuity causes the downstream annulus to be unevenly filled with pulverized coal dust, resulting in differential mixing with the oxidant.

SUMMARY OF INVENTION

The object of the invention is to create a simple pulverized coal burner which operates reliably at pressure under pulverized coal gasification conditions. By means of structural design measures the pulverized coal burner shall be embodied so as to ensure on the one hand reliable operation with uniform flame spread during the pressurized gasification of pulverized products and on the other hand so that the burner is technologically easy to manufacture.

This object is achieved in the case of a subject matter outlined by the features set forth in the preamble by means of the features of the characterizing portion of the claims.

Owing to the pulverized fuel feeding elements being implemented right up to the burner mouth and the instantaneous entry of the pulverized coal into the rotating oxygen stream there is no longer any areal discontinuity at the pulverized fuel outlet, since here the pulverized fuel stream is immediately sucked into the oxidant stream. At the outlet of the media the individual pulverized coal streams merge into a single rotating pulverized fuel dust/oxygen stream, thereby achieving an even flame spread and stabilization.

In a further embodiment of the invention the width and length of the flame spread can be influenced by means of different settings of the swirl blades.

Advantageous developments of the subject matter of the application are set forth in the dependent claims.

BRIEF DESCRIPTION OF THE DRAWINGS

The subject matter of the application is explained in greater detail below as an exemplary embodiment to the extent required for understanding and with reference to figures, in which.

In the figures, the same reference symbols are used to denote identical elements.

BRIEF DESCRIPTION OF THE DRAWINGS

The pulverized coal burner according to the invention comprises a centrally disposed pilot burner section 1 with fuel gas and oxidant supply, a flame monitoring device and an electrical high-voltage ignition device. Disposed around said module is an annulus 2 for supplying the oxidant for the pulverized coal burner. Swirl blades 3 for swirling the oxygen stream are provided at the annular outlet port. Both modules (pilot burner section and oxidant supply) are integrated in a further module, the burner carrier 5. The entire burner carrier module is implemented with a water cooling system in the form of a wound tube coil in order to dissipate the heat acting on said module. In addition, the modules disposed in the center of the burner carrier, i.e. pilot burner section and the further oxidant supply, are also equipped with separate water cooling systems.

Figure 1:
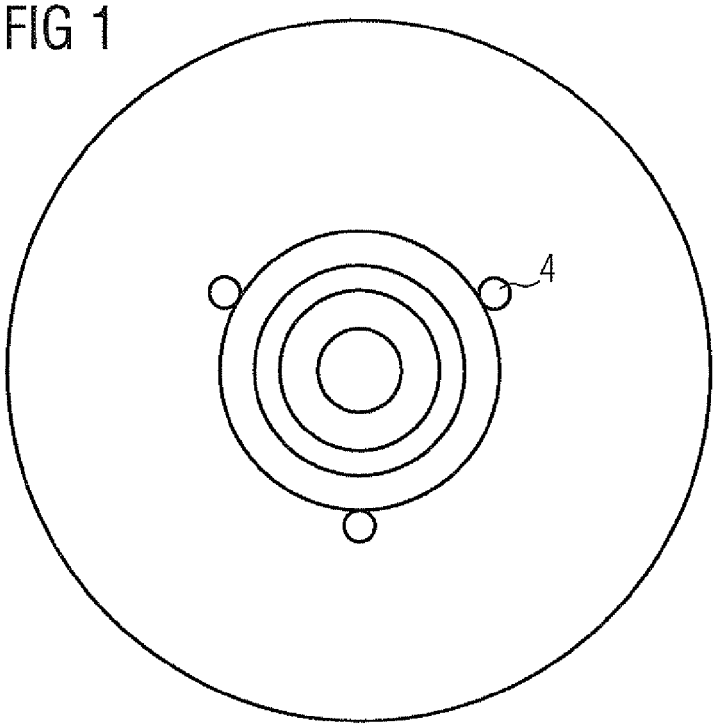
FIG. 1 shows a cross-section through the inventive compact burner comprising three supply tubes.
Figure 2:
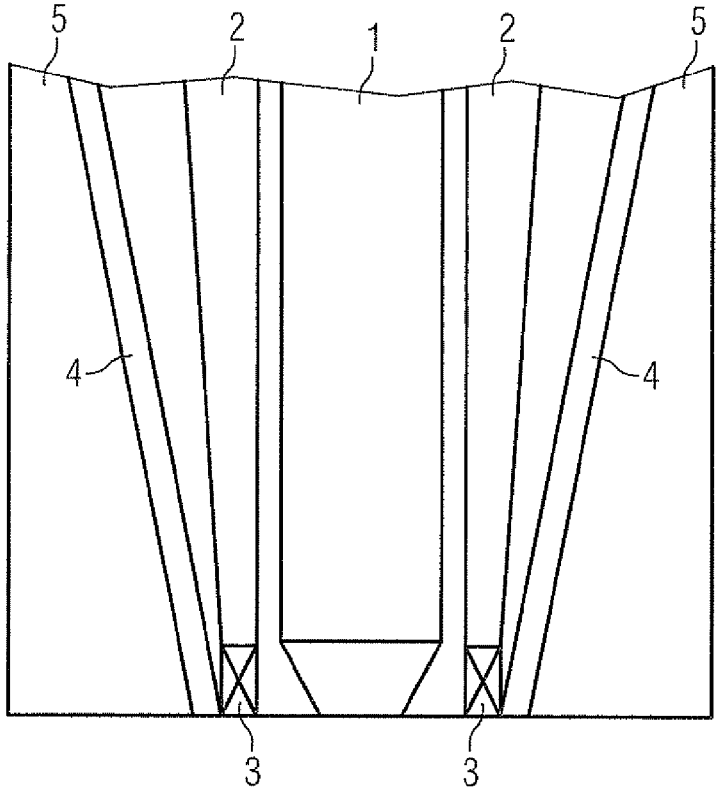
FIG. 2 shows a longitudinal section through the inventive compact burner.

According to the invention provision is made for the pulverized fuel to be supplied in such a way that a plurality (n=2, 3, . . . ) of straight pulverized coal feeding elements are disposed between the housing wall of the burner carrier and the central oxidant supply. The pulverized coal feeding elements are concentrically arranged around the central axis of the burner with the same angular offset. In the embodiment shown in FIG. 1 comprising three pulverized coal feeding elements they are concentrically arranged around the central axis of the burner with an angular offset of 120 degrees. The pulverized coal feeding elements are implemented intrinsically as straight and inclined in the direction of the burner mouth toward the burner axis, and end at the burner mouth adjacent to the oxidant outlet.

Implementing the oxidant supply using swirl blades results in a strong rotation being imparted to the discharging oxygen stream, into which the pulverized fuel jets discharging via the straight feeding elements are sucked.

The invention comprises a compact pulverized coal burner for the gasification of pulverized fuels under high pressures of, for example, 80 bar (8 MPa) and temperatures of, for example, 1200 to 1900° C. in reactors with liquid slag removal for oxygen gasification, having a housing (5) for accommodating a centrally disposed pilot burner (1) for starting up the compact burner unit and having a gas and oxidant supply as well as an integrated flame monitoring device and a high-voltage ignition device, an annular duct (2) disposed around said pilot burner (1) for supplying the oxidant, and straight feeding elements (4) inclined toward the burner axis, characterized in that a plurality of feeding elements (4) are present and said feeding elements (4) are embodied as intrinsically straight and inclined toward the burner axis and are implemented equiareally from the burner inlet up to the burner outlet, and end at the outlet immediately adjacent to the annular oxidant supply duct at the outlet of which swirl blades are present which impart a strong rotational movement to the oxygen stream and thus, as a result of appropriate design, allow the flame geometry to be influenced.

The invention claimed is:

1. A burner for the oxidant gasification of pulverized fuels, comprising: a centrally disposed pilot burner section arranged coaxially with an axial centerline of the burner; a concentric annular duct arranged coaxially around the pilot burner, where the concentric annular duct supplies the oxidant to an oxidant outlet; a plurality of pulverized coal feeding tubes, each carrying a pulverized coal stream, concentrically arranged in a circular array radially outside of the annular duct, wherein individual pulverized coal feeding tubes are intrinsically straight, and inclined toward the burner axis in a direction of the burner outlet, and end at the burner outlet adjacent to the oxidant outlet, wherein the annular duct has swirl blades, disposed at an annular duct outlet port at the burner outlet, that impart a rotational movement to the oxidant stream, and wherein the plurality of pulverized coal streams and the oxidant stream merge into a single rotating pulverized fuel dust/oxygen stream at the burner outlet, wherein the individual pulverized coal feeding tubes are equiareal from the burner inlet up to the burner outlet.

2. The burner as claimed in claim 1, wherein three pulverized coal feeding tubes are concentrically arranged radially outside of the annular duct.

3. The burner as claimed in claim 1, wherein the burner operates under a pressure of 80 bar.

4. The burner as claimed in claim 1, wherein the burner operates at temperature between 1200° C. and 1900° C.

5. The burner as claimed in claim 1, wherein the burner is water cooled.

* * * * *